US007750259B2

(12) United States Patent
Besana et al.

(10) Patent No.: US 7,750,259 B2
(45) **Date of Patent: *Jul. 6, 2010**

(54) SWITCH ADAPTABLE TO DIFFERENT OPERATING CONFIGURATIONS AND IMPROVED AXIAL SUPPORT

(75) Inventors: Stefano Besana, Terno d'Isola (IT); Gustavo Brignoli, Bergamo (IT); Federico Gamba, Bergamo (IT)

(73) Assignee: ABB S.p.A., Milan (IT)

( * ) Notice: Subject to any disclaimer, the term of this patent is extended or adjusted under 35 U.S.C. 154(b) by 104 days.

This patent is subject to a terminal disclaimer.

(21) Appl. No.: 11/914,246

(22) PCT Filed: May 3, 2006

(86) PCT No.: PCT/EP2006/062005

§ 371 (c)(1),
(2), (4) Date: Nov. 13, 2007

(87) PCT Pub. No.: WO2006/120142

PCT Pub. Date: Nov. 16, 2006

(65) Prior Publication Data

US 2008/0210532 A1 Sep. 4, 2008

(30) Foreign Application Priority Data

May 13, 2005 (IT) ..... BG2005A0024

(51) Int. Cl.
*H01H 1/22* (2006.01)

(52) U.S. Cl. ..... 200/244; 200/400; 361/634; 361/636

(58) Field of Classification Search ..... 200/400, 200/17 R, 329, 335, 339, 244; 361/614, 361/627, 634, 636
See application file for complete search history.

(56) References Cited

U.S. PATENT DOCUMENTS

| | | | | |
|---|---|---|---|---|
| 5,025,236 | A | 6/1991 | Miura et al. | |
| 5,479,143 | A * | 12/1995 | Payet-Burin | 335/202 |
| 5,539,167 | A * | 7/1996 | Hood et al. | 200/244 |
| 6,388,867 | B1 * | 5/2002 | Rakus et al. | 361/605 |
| 2004/0256207 | A1 | 12/2004 | Azzola et al. | |

FOREIGN PATENT DOCUMENTS

| | | | |
|---|---|---|---|
| GB | 2 006 527 | A | 5/1979 |
| WO | WO-03/009324 | A | 1/2003 |

* cited by examiner

*Primary Examiner*—Edwin A. Leon
*Assistant Examiner*—Vanessa Girardi
(74) *Attorney, Agent, or Firm*—Connolly Bove Lodge & Hutz LLP; Arlene P. Neal

(57) ABSTRACT

The present invention relates to a single-pole or multi-pole switch to be used preferably in low-voltage systems. The switch (1) comprises an outer casing (2) containing for each pole at least one fixed contact (10) and one mobile contact (20) that can be coupled to/uncoupled from one another. The mobile contacts (20) are housed in appropriate seats (25) provided on a mobile element (50). The switch (1) moreover comprises an energy-accumulation control mechanism (60), operatively connected to the mobile element (50) to enable its movement. The switch (1) according to the invention is advantageously provided with means of axial support operatively connected to the mobile element (50) in order to support the gravitational thrusts that are generated along the axis of rotation of the mobile element itself when said axis is inclined with respect to a substantially horizontal plane.

25 Claims, 11 Drawing Sheets

SWITCH ADAPTABLE TO DIFFERENT OPERATING CONFIGURATIONS AND IMPROVED AXIAL SUPPORT

RELATED APPLICATIONS

This application is a national stage application (under 35 U.S.C. §371) of PCT/JP2006/062005 filed May 3, 2006, which claims benefit of Italian application BG2005A000024 filed May 13, 2005, disclosure of which is incorporated herein by reference.

The present invention relates to a switch, in particular a circuit breaker or a disconnector, that can be installed according to different operating configurations and that is to be used preferably in low-voltage systems.

It is known that automatic switches and disconnectors, for reasons of brevity hereinafter referred to as switches, comprise one or more electrical poles, associated to each of which are at least one fixed contact and at least one mobile contact which can be coupled to/uncoupled from one another.

Automatic switches of the known art also comprise control means that enable movement of the mobile contacts, so bringing about their coupling to or uncoupling from the corresponding fixed contacts.

The action of said control means occurs traditionally on a main shaft that is operatively connected to the mobile contacts so that, following upon its rotation, the mobile contacts are moved from a first operating position to a second operating position, which are characteristic of an open and closed configuration, respectively, of the switch.

In the case of switches for low currents, indicatively of up to 800 A, there exist solutions that lead the main shaft to coincide with the mobile contacts, giving rise to a rotating mobile element capable of guaranteeing insulation between the phases and of course correct transmission of the movements and of the forces involved. The mobile element is usually supported by structural parts of the box for containing the switch, which, together with the mobile element itself, basically form bearing areas.

As the currents involved increase, an increasing performance of mechanical tightness are required of the mobile element, given the same dielectric characteristics, which, in any case, must be preserved and guaranteed.

From the practical standpoint, the requirement of better mechanical characteristics results in an increase in the radial dimensions of the mobile element, with a consequent increase in the friction that is created in said bearing areas. This of course adversely affects the performance of the apparatus and tends to reduce the duration of the switch and of its parts, with progressive degradation of the overall mechanical efficiency.

To overcome the above drawback in arrangements also for high values of currents and breaking capacities, metal reinforcement shafts that pass through the mobile element have also been used. These, however, may interfere with the characteristics of electrical insulation between the poles and are certainly far from advantageous from the functional standpoint. In practice, these aspects for the moment limit the use of the mobile element to switches for low currents and low breaking capacities.

The increase in the radial dimensions of the mobile element, i.e. the increase in the weights involved may jeopardize correct installation of switches for high currents and high breaking capacities at different angles from the design one. This basically means that, in the state of the art, a switch for high currents or high breaking capacities designed to have the axis of the mobile element horizontal, cannot be installed according to different configurations, i.e. according to ones that bring said axis to be in a position different from the design one. Installations according to different angles jeopardize, in fact, the functionality of the switch since the weight of the mobile element may cause friction and bending that alter the normal conditions of coupling between the parts and of operation of the switch itself.

There consequently exists the need to extend the use of the mobile element also to those switches designed to operate with higher currents and breaking capacities in order to obtain greater flexibility of installation in the presence, for instance, of wiring systems or switchboards with busbars having a horizontal development.

On the basis of these considerations, the main task of what forms the subject of the present invention is to provide a switch that will enable the limits and drawbacks referred to above to be overcome.

In the framework of this task, a purpose of the present invention is to provide a switch that has a compact structure, which can be easily assembled and is made up of a limited number of components.

Another task of what forms the subject of the present invention is to provide a switch in which the friction between the different parts making up the switch will be extremely limited in any configuration of installation and will be compatible with a long service life and high levels of performance.

A further purpose of the present invention is to provide a switch that is functionally flexible, i.e. that can be installed in any operating configuration.

Not the least important purpose of what forms the subject of the present invention is to provide a switch that will present a high reliability, will be relatively easy to make, and offer competitive costs.

This task, as well as the above and other purposes that will emerge more clearly from what follows, are achieved through a single-pole or multi-pole switch for low-voltage wiring systems, comprising:

an outer casing containing for each pole at least one fixed contact and at least one mobile contact, which can be coupled to/uncoupled from one another;

a mobile element, defined by a shaped body comprising at least one seat for each pole of said switch, said seat being designed to house at least one mobile contact of a corresponding pole; and an energy-accumulation control mechanism, operatively connected to said mobile element to enable its movement.

The switch according to the invention is characterized in that it comprises means of axial support, operatively connected to said mobile element.

The means of axial support are used for countering the gravitational thrusts on the mobile element generated when the latter is installed with the axis of rotation inclined with respect to a horizontal plane. The use of said means enables, in fact, limitation of the friction between the different parts that come into contact, thus guaranteeing proper functionality of the switch in any operating configuration.

Further characteristics and advantages of the invention will emerge more clearly from the description of preferred but non-exclusive embodiments of the switch according to the invention, illustrated by way of example in the attached plate of drawings, wherein.

Figure 1:
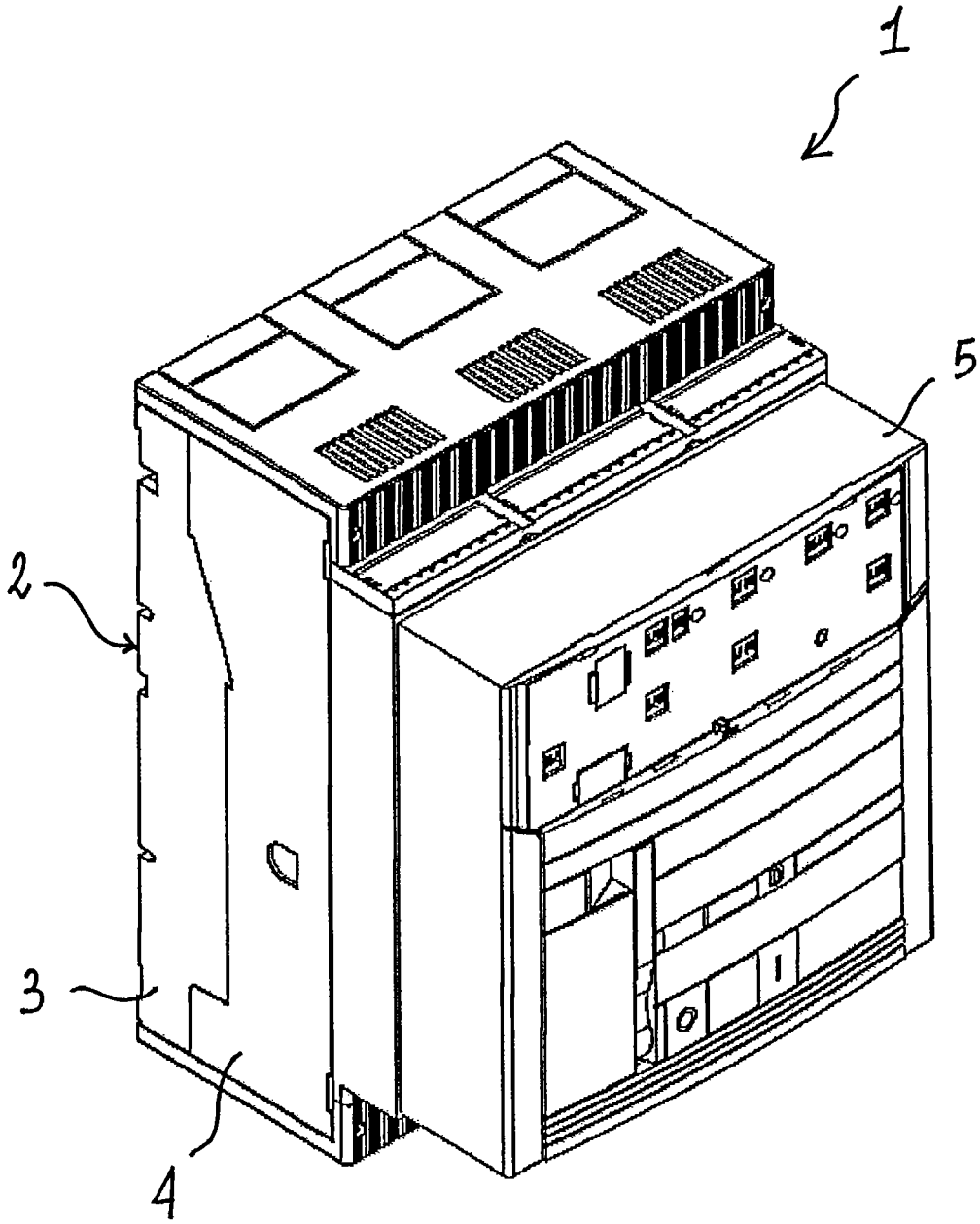
FIGS. 1 and 2 are respectively a first perspective view and a second perspective view of a switch according to the invention.

With reference to the above figures, the switch according to the invention comprises an outer casing 2 containing one or more electrical poles, each defined by at least one fixed contact 10 that couples to/uncouples from at least one mobile contact 20. The outer casing 2 also houses a mobile element 50 made up of a shaped body made of insulating material, preferably a thermosetting resin, which comprises at least one seat 25 for each pole of the switch 1. Operatively connected to the mobile element 50 is a control mechanism 60 that enables movement thereof about a pre-set axis of rotation 100. The control mechanism 60 used is preferably of the energy-accumulation type normally employed in applications that envisage high values of current and/or breaking capacity.

The switch 1 according to the invention is characterized in that it comprises means of axial support that are operatively connected to said mobile element 50 in order to counteract the gravitational thrusts that are generated along its axis of rotation 100. These gravitational thrusts arise when said axis of rotation 100 is inclined with respect to a substantially horizontal plane. As hereinafter illustrated in detail, the presence of these supporting means enables limitation of any bending or friction that is generated on account of these gravitational thrusts, consequently increasing the number of the possible operating configurations of the switch 1.

Figure 2:
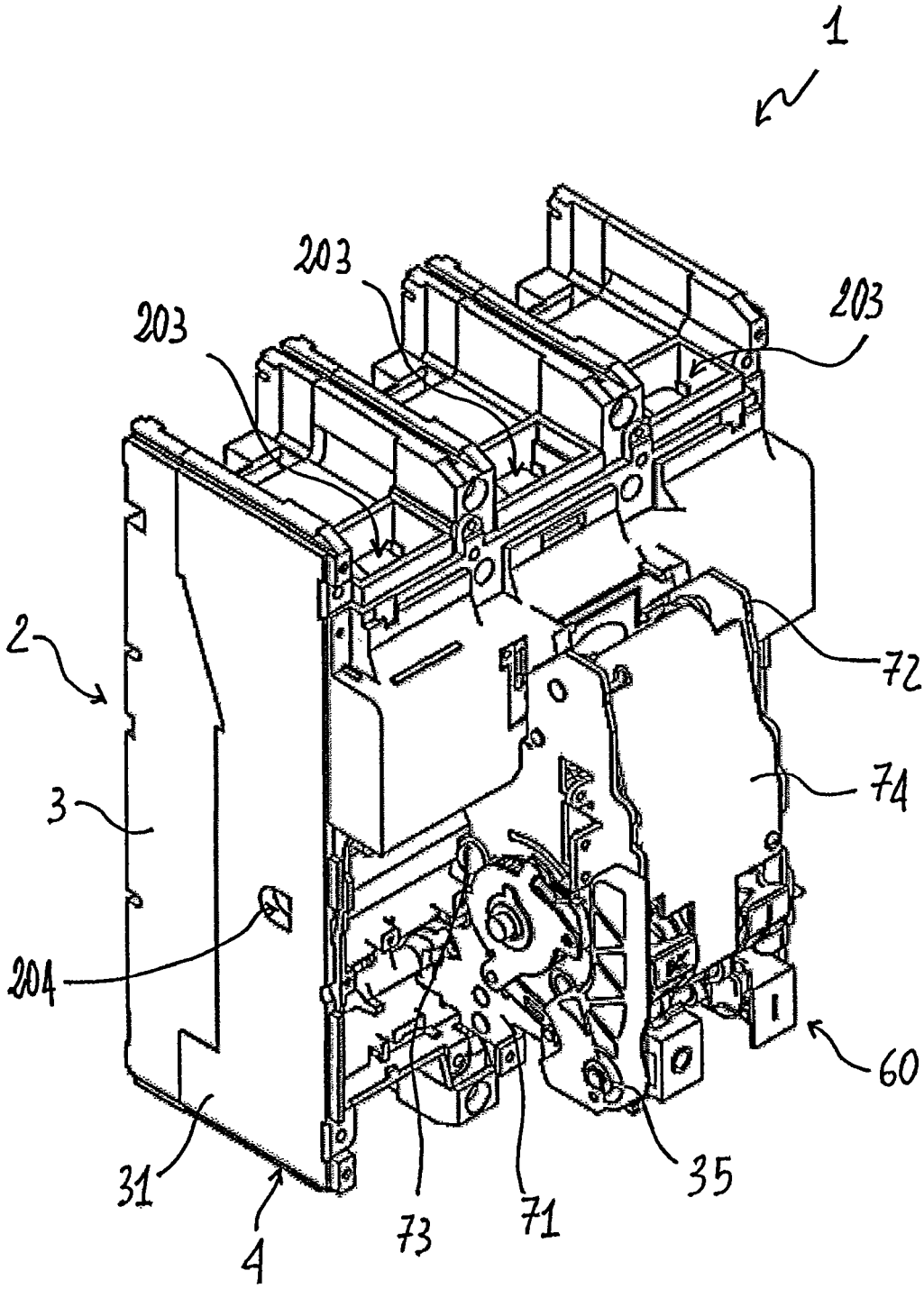

With reference to FIGS. 1 and 2, the outer casing 2 of the switch according to the invention 1 is preferably made up of a bottom 3, which is coupled to a lid 4 so as to generate spaces, within which the strictly electrical components of the switch 1 are housed. Alternatively, the outer casing can be made of sheet metal, as commonly occurs in switches of the so-called "open" or "air circuit breaker" (ACB) type.

The structure of the casing 2 can be advantageously completed by a protective mask 5 that is applied to the lid 4 and, if necessary, can be easily removed by an operator to enable access to the internal parts of the switch 1.

Figure 4:
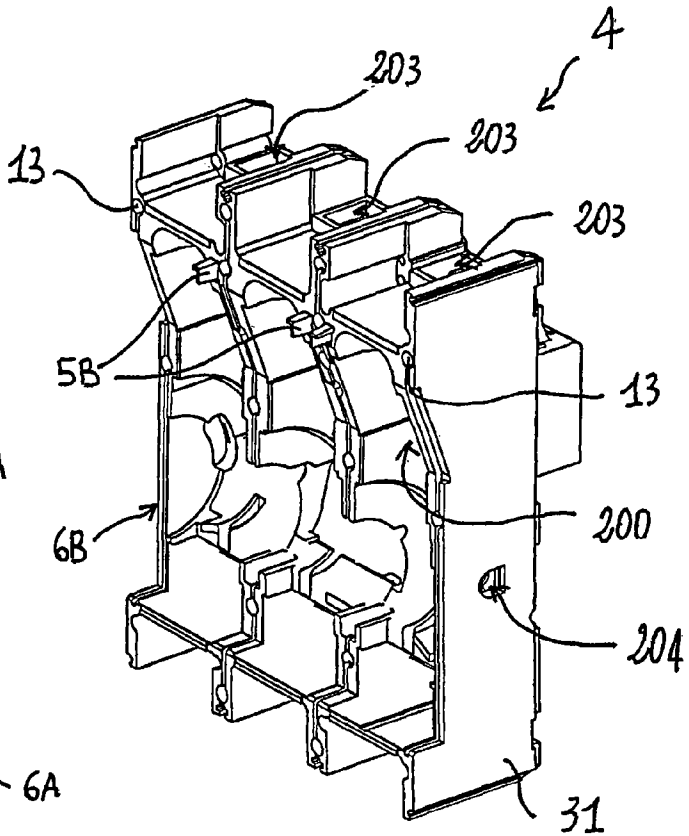
FIGS. 3 and 4 are perspective views of components of an outer casing of a switch according to the invention.
Figure 3:
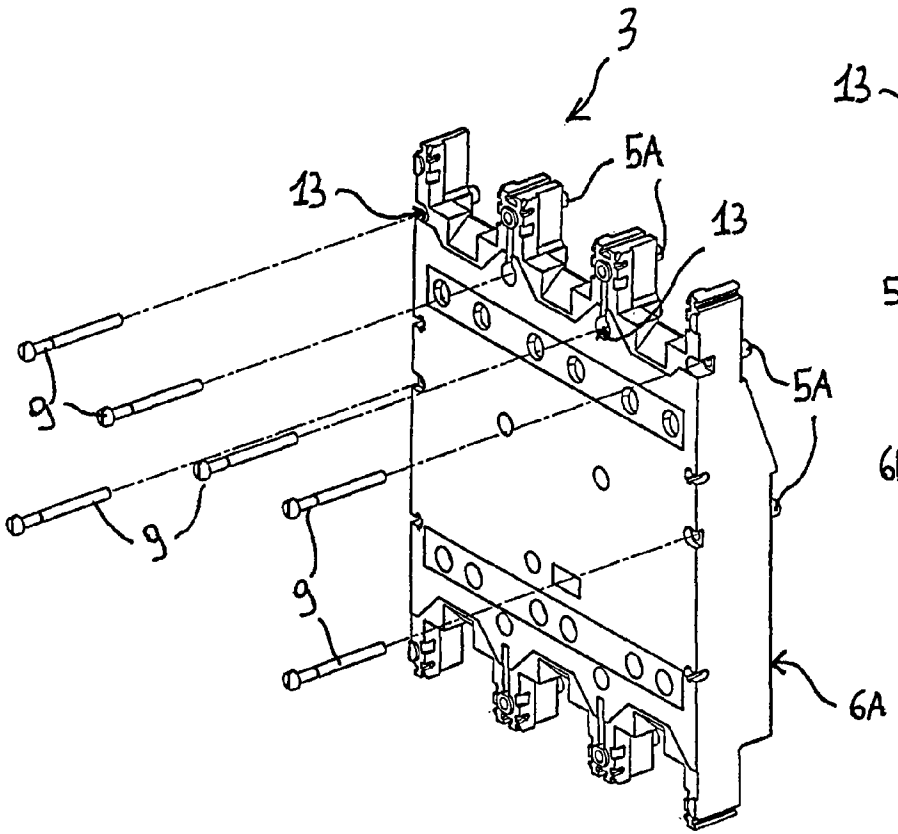

FIGS. 3 and 4 illustrate a possible embodiment of the parts making up the outer casing 2. In particular, the bottom 3 comprises a first coupling surface 6*a*, from which there emerges a series of protrusions 5*a*, designed to be inserted in cavities 7*b* provided on a second coupling surface 6*b* of the lid 4. Likewise, also from this second surface 6*b* there emerge other protrusions 5*b*, which can be inserted in corresponding cavities provided on the first coupling surface 6*a*. Basically the two coupling surfaces 6*a* and 6*b* have shapes that can at least in part be geometrically mated to one another, i.e., which enable co-penetration of the parts making up the entire casing 2. The tightness of the coupling is moreover guaranteed by a series of fastening screws 9 that ensure an adequate resistance of the casing 2 against the stresses to which it is subjected during normal operation of the switch 1. As illustrated, the fastening screws 9 are inserted in holes 13 made both on the bottom 3 and on the lid 4 and can alternatively be replaced by other functionally equivalent means, such as for example bolts or tie-rods.

Figure 5:
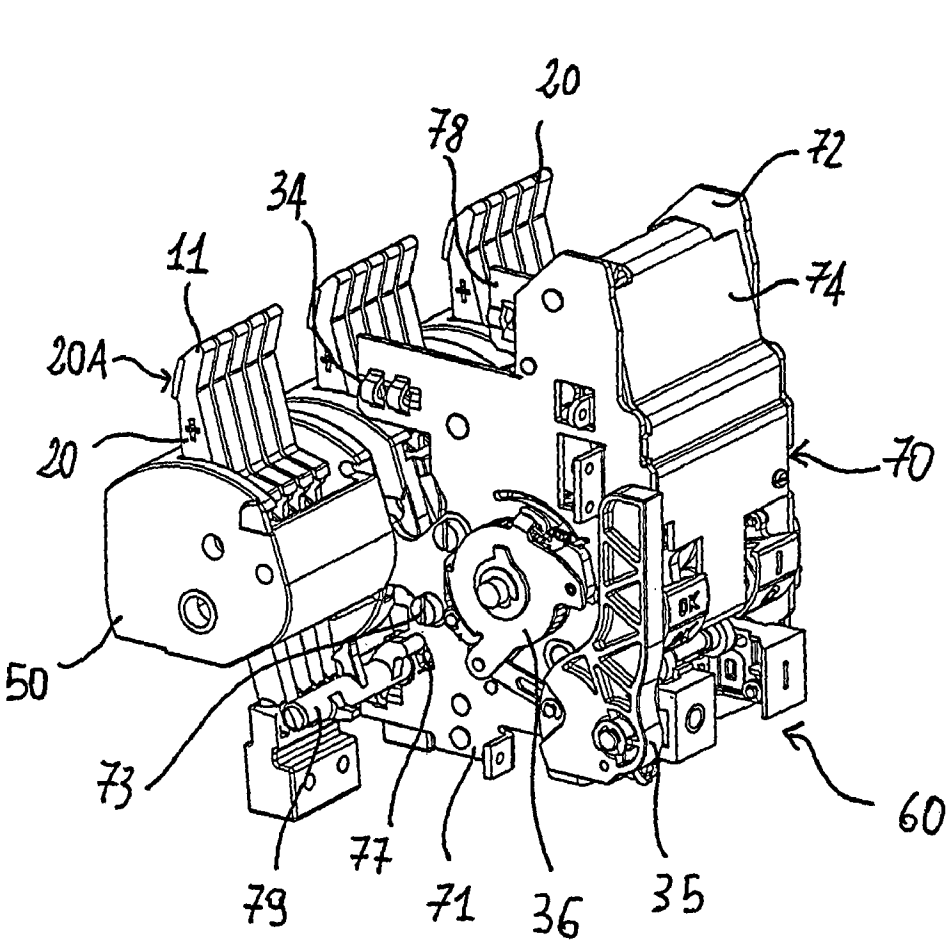
FIG. 5 is a first exploded view of a first embodiment of a switch according to the invention.
Figure 5:
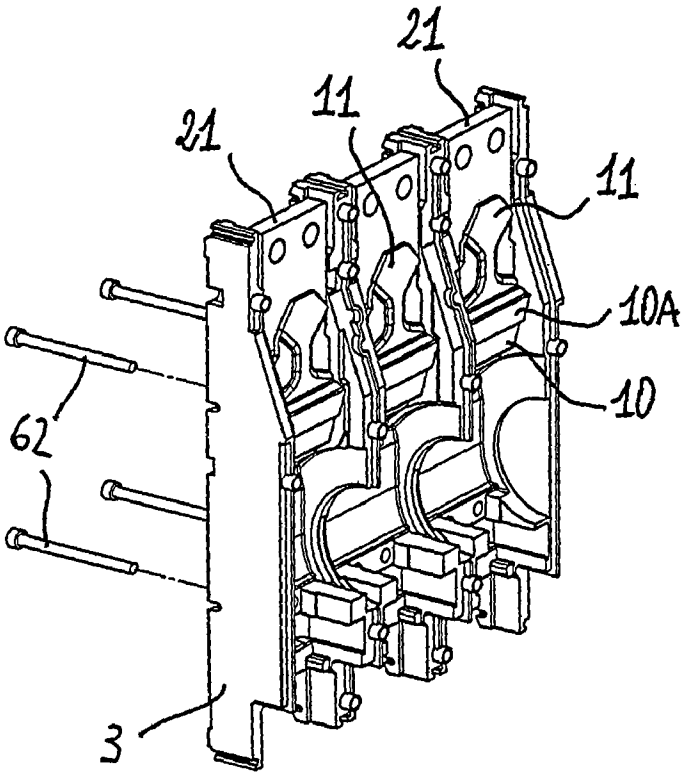

FIG. 5 (described hereinafter in detail) provides a better view of the inner side of the bottom 3, on which the fixed contacts 10 are provided, each electrically connected to an electrode 21. The fixed contacts 10 illustrated each comprise an active part 10*a* that comes into contact with a corresponding active part 20*a* provided on the mobile contacts 20. Both the fixed contacts 10 and the mobile ones 20 can advantageously comprise an arc chute 11 that has the task of deviating the electric arc in order to limit degradation of the active parts of the contacts themselves.

In the case of use of outer casings of a metal type, as occurs normally in devices of an open type (ACBs—air circuit breakers), insulating elements will be set between the fixed contacts and the casing itself, as in the known art.

With reference once again to FIG. 4, the lid 4 can be advantageously made of insulating material to improve the electrical insulation between the metal parts making up the switch. The lid 4, by being coupled to the bottom 3, generates at least one arc chamber 200 for each pole of the switch. Preferably housed within each arc chamber 200 are arc-breaking elements that have the function of facilitating extinction of the arc that is generated following upon separation of the contacts of the switch 1. Each arc chamber 200 comprises at least one top opening 203, which constitutes the outlet for discharge of the gases that are generated following upon setting-up of the electric arc. The lid 4 also has side openings 204, which enable an operator to gain access to the mobile element 50 in order, for example, to place or remove the means of connection between the control mechanism 60 and the mobile element 50, or else to enable the shafts or bars for signalling the state (for example open, closed, tripped) to come out.

Figure 6:
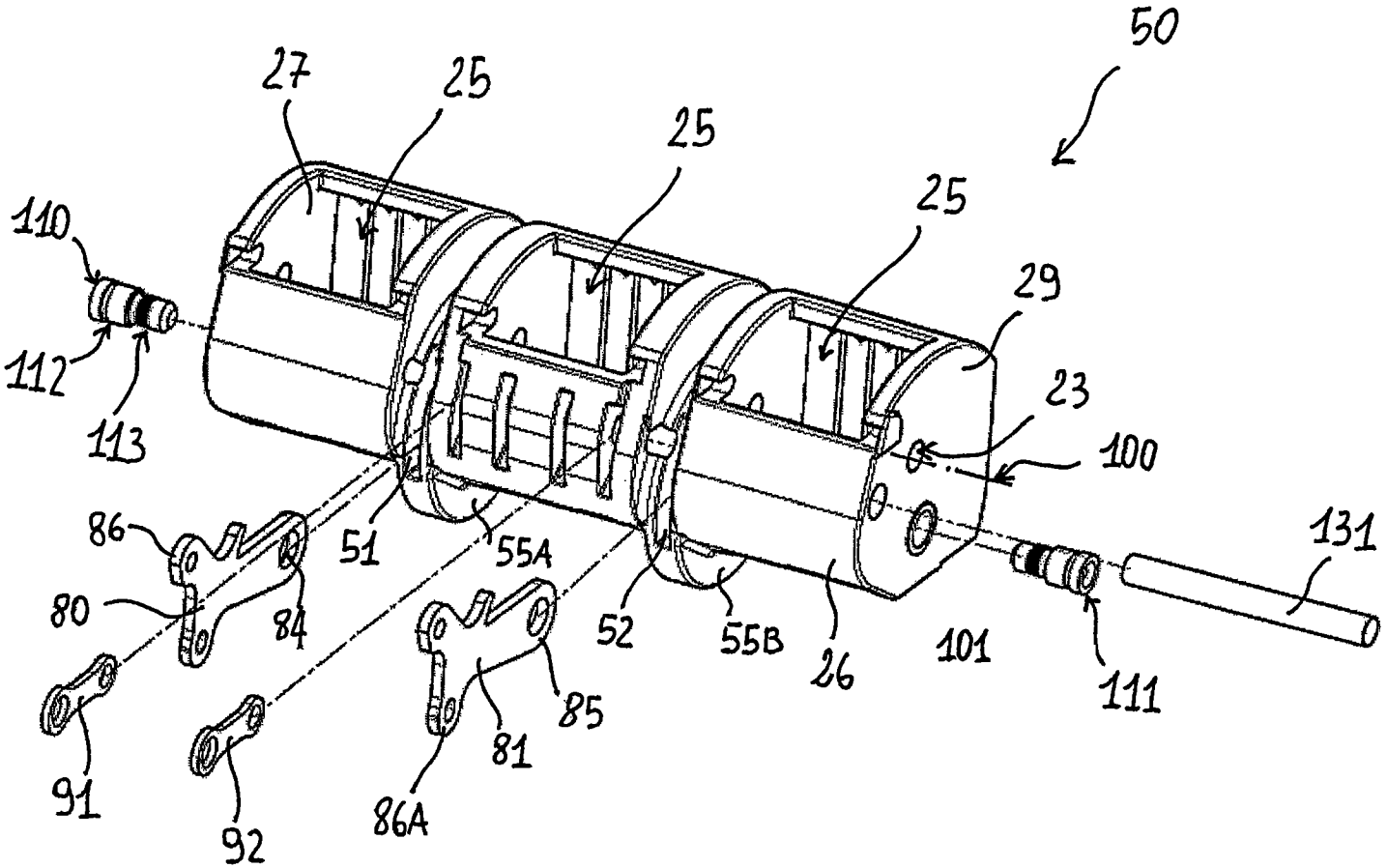
FIGS. 6 and 7 are perspective views of a mobile element according to the invention.
Figure 7:
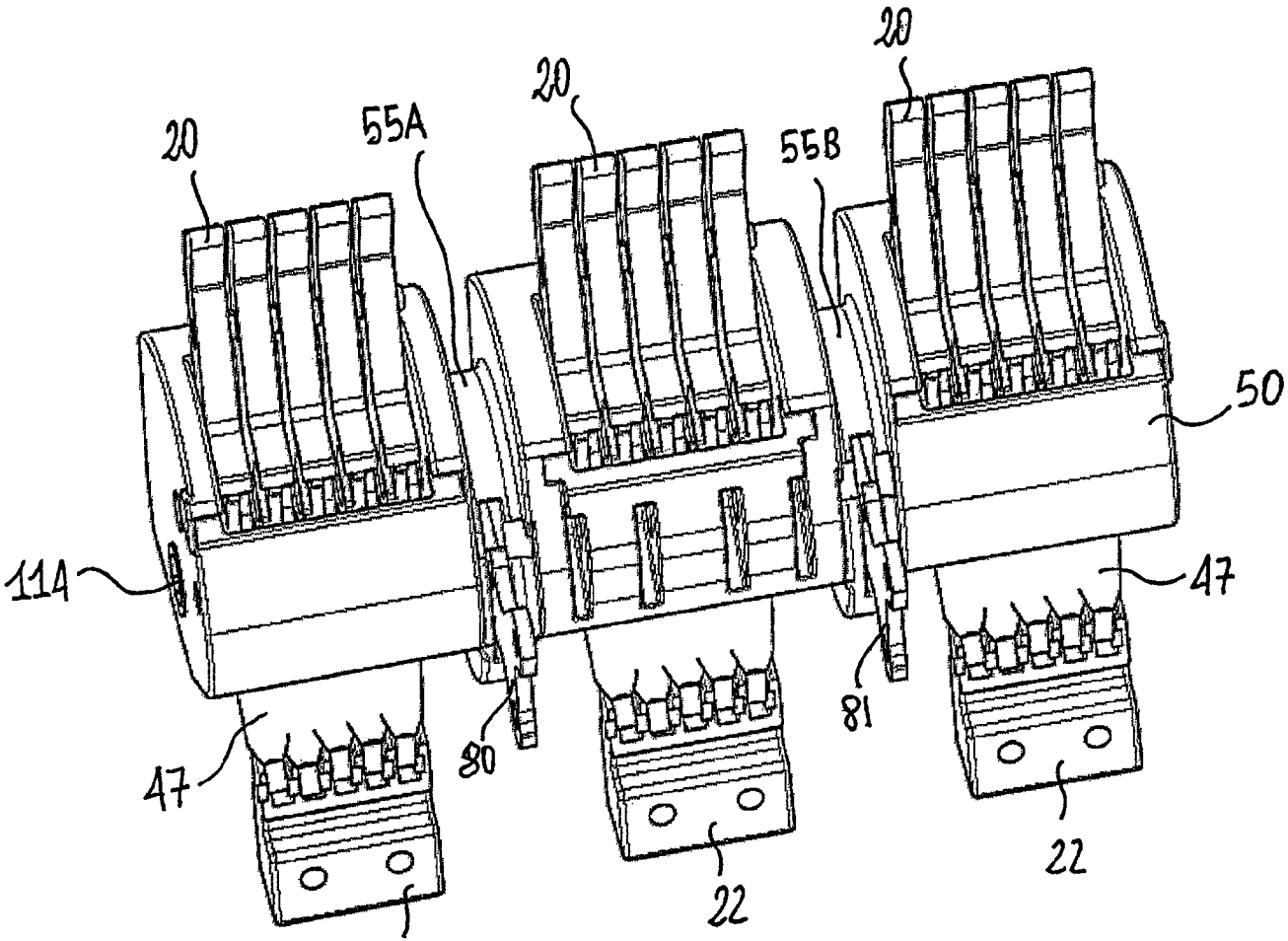

FIGS. 6 and 7 illustrate a possible embodiment of a mobile element 50 according to the invention, and more in particular a mobile element for a three-pole switch. This does not exclude the possibility of the technical solutions presented hereinafter from being used also for switches having a different number of poles. With reference now to FIG. 6, the mobile element 50 is defined by a shaped body that comprises a seat 25 for each pole of the switch 1. Housed in each seat 25 is a mobile contact 20 that can be made of a single piece or else of a plurality of mutually adjacent components, as is clearly illustrated in FIG. 7. These seats 25 are provided so as to be mutually adjacent and particularly arranged so that the mobile contacts 20 housed therein will have a common axis of rotation 100 with respect to the mobile element itself Said axis of rotation 100 is physically constituted by transverse rotation pins (not visible in the figures), which are arranged on appropriate housings 23 obtained in each of the seats 25.

In a preferred embodiment thereof, the seats 25 are defined basically by a front wall 26, a rear wall 27, substantially opposite to the front one 26, and by a first side wall 28 and a second side wall 29 substantially opposite to one another. These walls are mutually arranged in such a way as to generate at least one first opening and one second opening, from which there come out, respectively the corresponding mobile contact 20 and means of electrical junction 47 (see FIG. 7). The latter, consisting, for instance, of a copper braid, connect the mobile contact 20 electrically to an electrode 22, which is in turn connected to the electrical network in which the switch 1 is inserted. In the case where the switch 1 functions according to the known principle of double interruption, then from the second opening there may advantageously come out other electrical contacts designed to couple with a further series of fixed contacts altogether similar to the ones referred to above.

The mobile element 50 comprises circular connecting parts 55*a* and 55*b*, located between two adjacent seats 25. In the solution illustrated in FIGS. 7 and 8, these circular connecting parts 55*a* and 55*b* emerge for a portion thereof with respect to the space occupied by the seats 25. This solution is to be considered only as a possible and certainly not exclusive embodiment of the mobile element 50.

Each of these connecting parts 55*a* and 55*b* comprises at least one radial recess, the function of which will be illustrated hereinafter. More precisely, the mobile element 50 illustrated in FIGS. 6 and 7 comprises a first connecting part 55*a* and a second connecting part 55*b*, respectively comprising a first radial recess 51 and a second radial recess 52.

In a preferred embodiment thereof, illustrated once again in FIG. 7, the means of axial support are made up of at least one first axial supporting arm 80 and one second axial supporting arm 81 having at least two mutually opposed ends. In particular, each of them comprises at least one first operative end 85, which is connected to the mobile element 50 and one second retention end 86, which is constrained to the structural part 70 of the control mechanism 60. According to a preferred embodiment, the two supporting arms 80 and 81 have a "three-lobed" configuration, comprising a third retention end 86*a* adjacent to the aforesaid second end 86.

FIG. 5 is an exploded view of a first embodiment of the switch 1 according to the invention. The control mechanism 60 of the switch 1 is basically made up of mechanical means supported by a structural part 70, which is stably connected to the outer casing 2, for instance by means of the use of axial tie-rods 62 or other functionally equivalent means. In particular the structural part 70 of the control mechanism 60 comprises fastening protrusions 78, on which there are provided threaded cavities 34, in which said axial tie-rods 62 are screwed, thus enabling fixing of the control itself to the containing casing 2 of the switch 1 and in particular to the bottom 3. The structural part 70 of the mechanism 60 basically comprises a first side 71 and a second side 72, set between which is a transverse wall 74 that has the purpose of increasing the mechanical rigidity of the control 60. Set laterally with respect to this transverse wall 74 is a loading lever 35, which has instead the function of actuating a device 36 for loading the springs of the mechanical means. In the solution illustrated, the first side 71 also comprises a side opening 77 provided to enable passage of members 79 for signalling the state of the switch 1 (for example, open, closed, tripped).

The axial supporting arms 80 and 81 are preferably constrained to the control mechanism 60 on the outer side of each side 71 and 72 through the use of removable fixing means 73, for instance screws or alternatively rivets. In a further solution, the supporting arms 80 and 81 could also be made of a single body with the sides 71 and 72, and hence without the use of fixing means.

Figure 9:
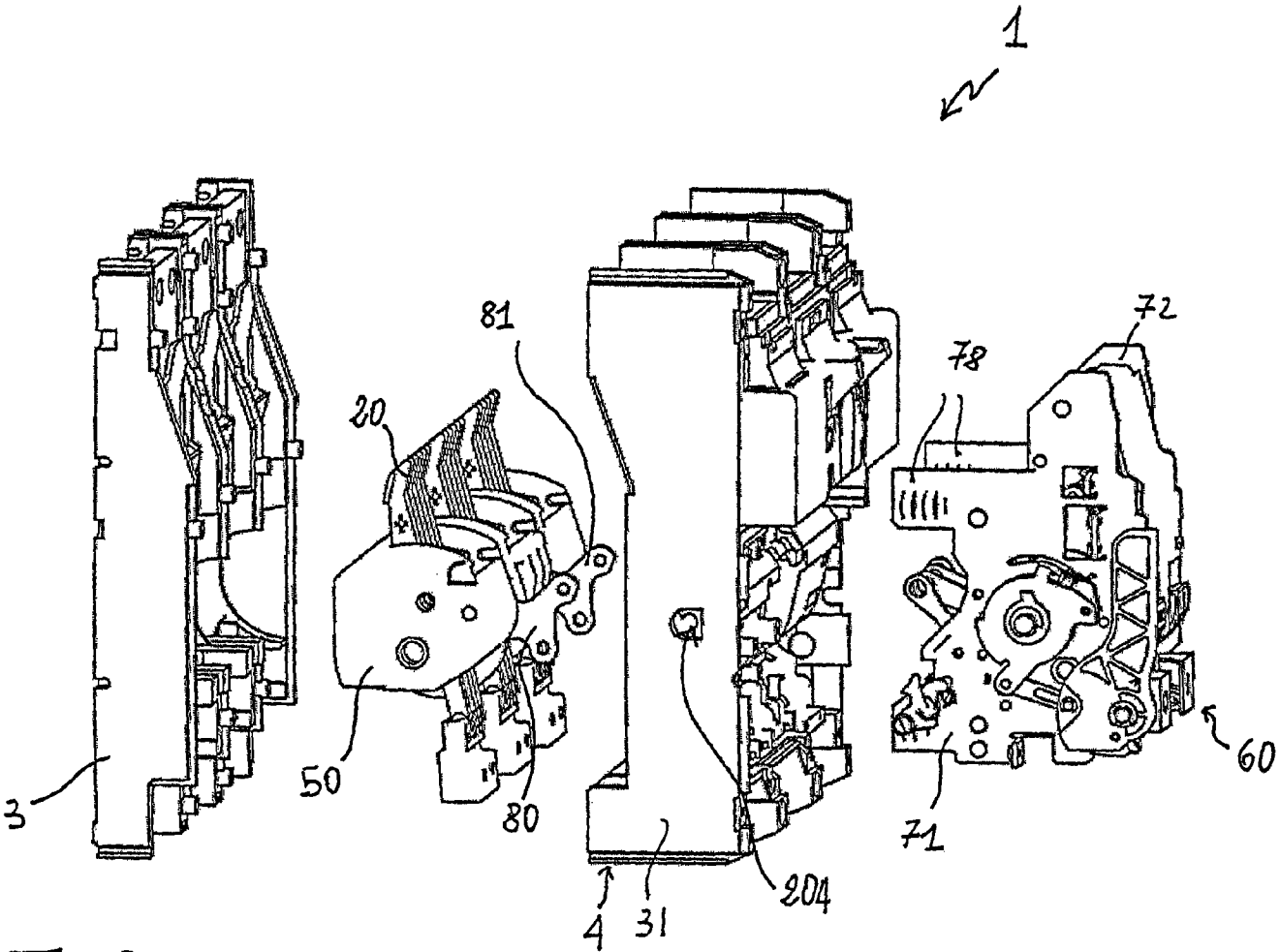
FIG. 9 is a second exploded view of the switch according to the invention, illustrated in FIG. 5.

It is evident that said connection renders the mobile element 50 substantially suspended in cantilever fashion with respect to the casing 2, and for said purpose the "three-lobed" shape of the supporting arms 80 and 81 is particularly advantageous in so far as it enables a greater resistance to bending and thus a more stable positioning of the mobile element itself. The supporting arms 80 and 81 provide the centre of rotation for the mobile element 50 through a hinge connection. The latter is provided within said radial recesses 51 and 52, which are pre-arranged in the connecting parts 55*a* and 55*b* of the mobile element 50. With reference, in particular, to FIG. 6, the hinge connection means comprise, for each supporting arm 80 and 81, a rotation pin 110 and 111, which is inserted in a first hole 84 made on the first operative end 85 and in a second hole provided on the mobile element 50. FIG. 6 also shows a preferred embodiment of these rotation pins 110 and 111, which have at least one first calibrated longitudinal portion 112 that is coupled to the internal surface of the first hole 84 made on the corresponding supporting arm 80 or 81. Each pin advantageously also comprises a second retention portion 113, which is constrained by friction or by screwing to the second hole of the mobile element 50. In practice, the retention portion 113 enables positioning of the pin with respect to the mobile element 50, whilst the calibrated portion enables rotation of the mobile element itself with respect to the supporting arms 80 and 81 that support it. From the standpoint of assembly, the solution described is extremely advantageous in so far as each rotation pin has contained axial dimensions that facilitate positioning thereof within the mobile element 50 in a position corresponding to the radial recesses 51 and 52. FIG. 9 illustrates a cross-sectional view of the connection in question, and the advantages of this solution emerge clearly. The rotation pins are located in their operative positions, exploiting gaps 114 made on the side walls of the housing seats 25. The contained axial dimension of the rotation pins 110 and 111 advantageously improves also the mechanical reliability of the connection.

With reference once again to FIG. 7, the operative ends of the supporting arms 80 and 81 and the radial recesses 51 and 52 of the mobile element 50 are coupled in an extremely precise way in order to limit any play as much as possible. In addition, the surfaces of the arms 80 and 81 and the internal surfaces of the radial recesses 51 and 52 are mutually compatible in order to limit as much as possible any phenomena of friction. This area of contact functions in practice as a bearing in so far as it supports the mobile element 50, in any case enabling rotation thereof irrespective of the inclination of the axis of rotation 100.

Figure 8:
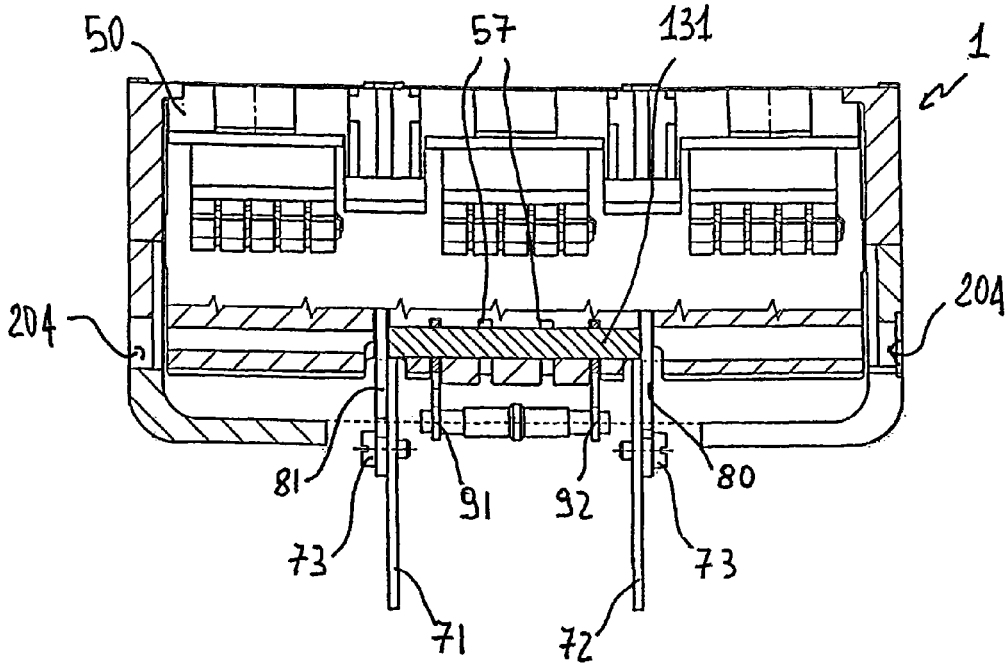
FIG. 8 is a cross-sectional view of the switch represented in FIG. 5.

FIGS. 6 and 8 enable appreciation of a possible mode of connection between the control mechanism 60 and the mobile element 50. In particular, the control mechanism 60 comprises a first connecting rod 91 and a second connecting rod 92, which are operatively connected to the mobile element 50 through a common transverse driving pin 131. The connection rods 91 and 92 are inserted in hollow sectors 57 obtained on the front walls of the seats 25 of the mobile element 50 and perforated transversely for housing the driving pin 131.

With reference in particular to FIG. 6, these hollow sectors 57 are made on the mobile element 50 substantially on the same side on which the radial recesses 51 and 52, which are used for connection of the supporting arms 80 and 81, are provided. The presence of a plurality of hollow sectors 57 is particularly advantageous in so far as it enables positioning of the connection rods 91 and 92 at variable distances according to the type of control that is used. As an alternative to the hollow sectors 57, perforated radial protrusions could be provided for the insertion of the driving pin 131. The latter, however, must in any case be arranged in a position that is eccentric with respect to the axis of rotation of the mobile element 50, provided by the aforesaid rotation pins 100 and 101 coupled to the supporting arms 80 and 81. In this way, following upon a displacement of the driving pin 131, a torque is generated that drives the mobile element 50, and consequently the mobile contacts 20, in rotation.

FIG. 9 is a second exploded view of a switch 1 according to the invention and enables appreciation of the modalities with which the latter can be assembled.

An initial step envisages connection of the two supporting arms 80 and 81 in the radial recesses 51 and 52 and installation of the mobile element 50 through placing of the mobile contacts 20 in the seats 25. The mobile contacts 20 are in this step preferably already connected to the corresponding electrodes 22 through the aforementioned electrical-junction means 21. Next, the mobile element 50 is placed within the outer casing 2 generated by the coupling between the bottom 3 and the lid 4 and then connected to the control mechanism 60. In particular, the connection rods 91 and 92 of the kinematic means are fixed to the mobile element 50 in a position corresponding to the hollow sectors 57 thereof and through the use of the transverse pin 131. The supporting arms 80 and 81 are then fixed to the sides 71 and 72 of the structure 70 of the control 60 via the removable fixing means 73 in a position corresponding to the retention ends 86 and 86*a* provided on the arms themselves. The control 60 is then located in the correct operating position by means of the use of the axial tie-rods 62 that connect it stably to the bottom 3.

The sides 71 and 72 of the structure of the control 60 are shaped in such a way as to mate with the rear wall of the lid, which functions in practice as spacer between the control itself and the bottom. In this way also the mobile element 50 suspended from the control 60 is placed in the correct operating position.

The presence of the lid made of insulating material contributes also to improving the insulation of the control with respect to the electrical parts.

FIG. 2, which has already been mentioned, illustrates the switch 1 at the end of the main steps of assembly referred to above. In particular, there may be noted the side opening 204 made on the side 31 of the lid 4, which enables access inside the lid itself to enable placing or removal of the transverse driving pin 131 that connects the control 60 to the mobile element 50. This solution basically enables removal of the control 60 from the switch 1, without disconnecting the two walls making up the casing 2, with obvious advantages from the practical standpoint.

Figure 10:
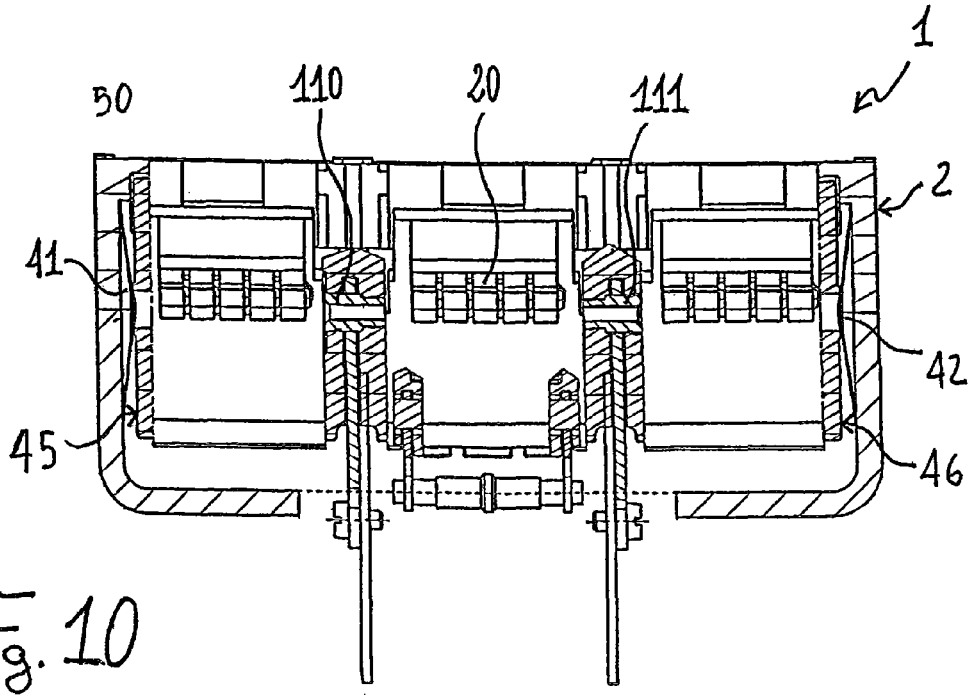
FIG. 10 is a cross-sectional view corresponding to a second embodiment of a switch according to the invention.

FIG. 10 shows a second possible embodiment of the means of axial support according to the invention. In particular, they comprise a first axial bearing 41 and a second axial bearing 42, located between the end parts 45 and 46 of the mobile element 50 and the outer casing 2. The bearings can be advantageously of the thrust-bearing type, or alternatively ball-bearing, roller-bearing, or conical-bearing type. The use of the axial bearings 41 and 42 is particularly advantageous if combined with that of the supporting arms previously described in so far as the axial thrust sustained is greater. In this way, also automatic switches of large dimensions, such as for example the so-called open circuit breakers or air circuit breakers (ACBs), can easily be installed according to different angles, preserving a perfect functionality.

Figure 11:
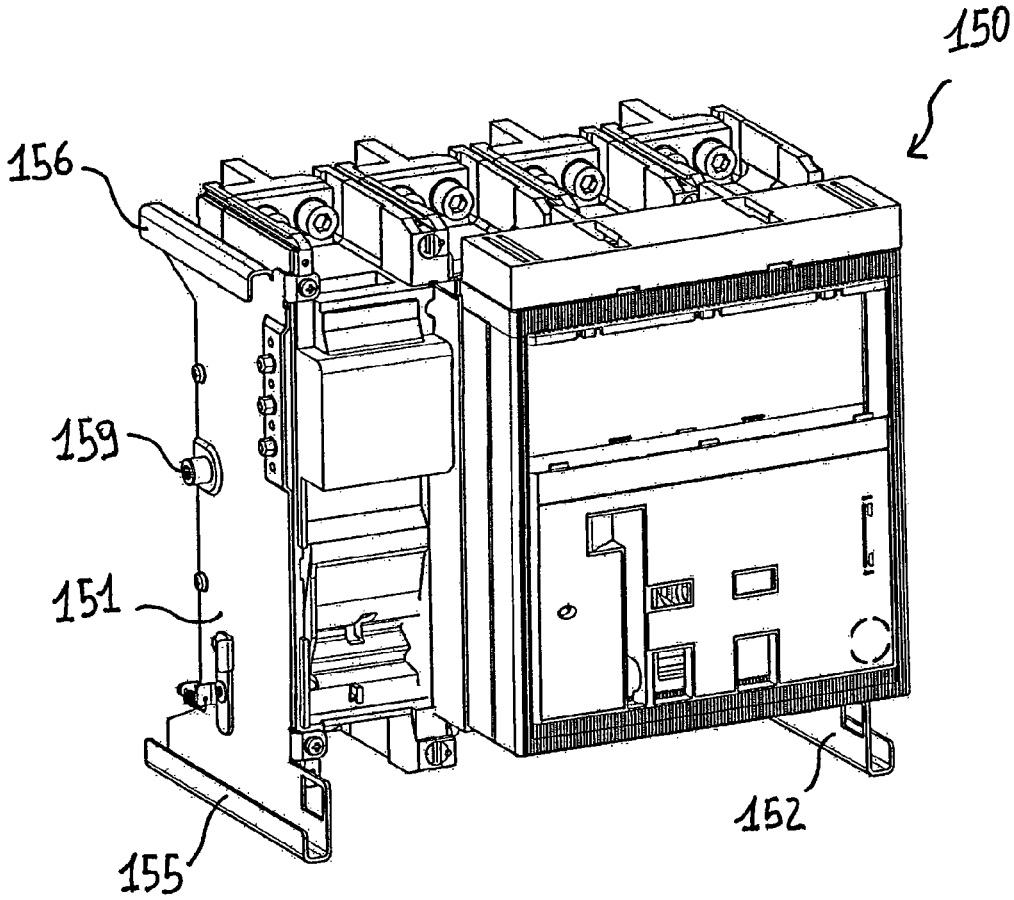
FIG. 11 is a perspective view of the mobile part of a withdrawable switch according to the invention.
Figure 12:
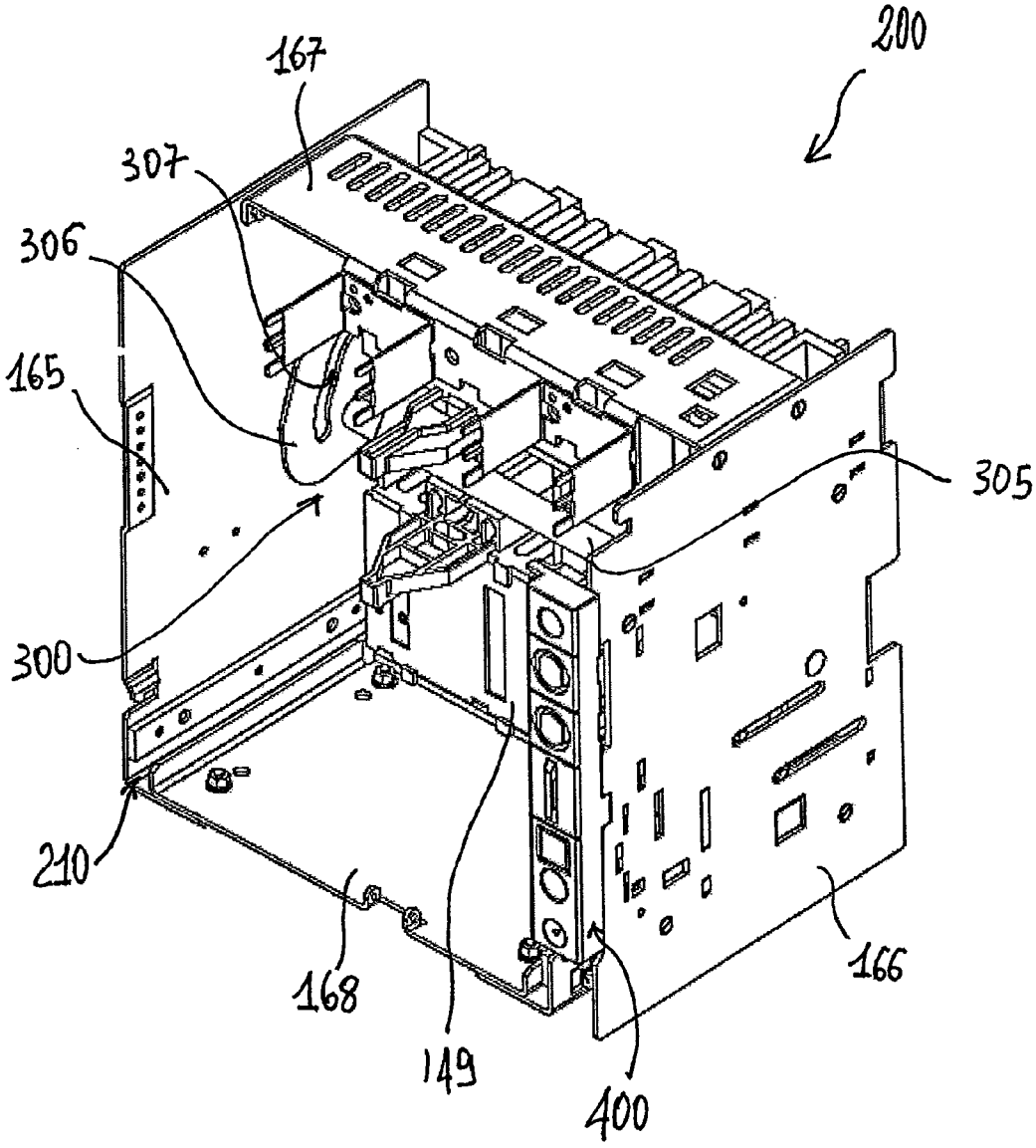
FIG. 12 is a perspective view of the mobile part of a withdrawable switch according to the invention.
Figure 13:
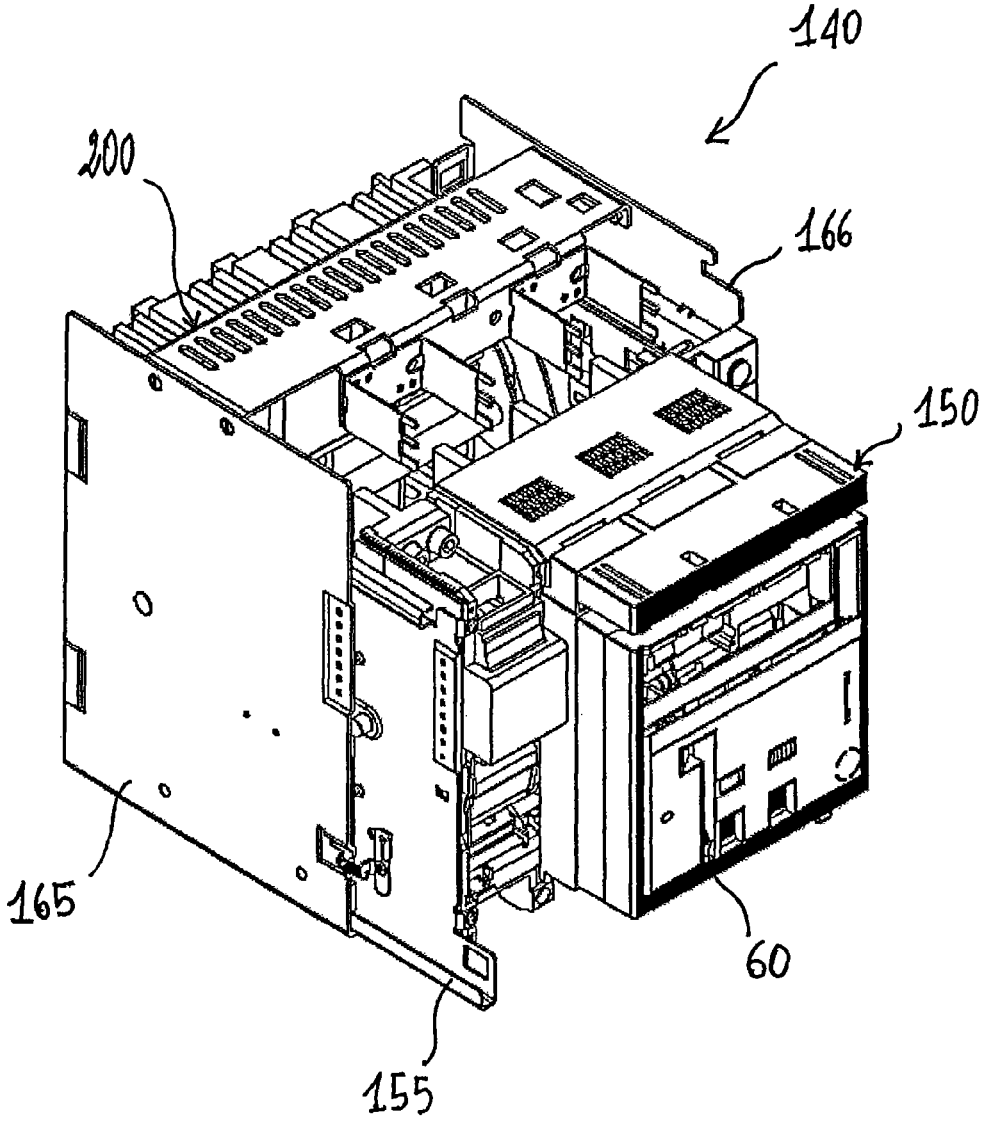
FIG. 13 is a view that illustrates the modalities of assembly of the parts represented in FIGS. 11 and 12 of a withdrawable switch according to the invention.

With reference to FIGS. 11 to 13, the present invention also relates to a withdrawable switch or circuit breaker 140, characterized in that it comprises a mobile part 150 and a fixed part 200, which is structurally built so as to contain said mobile part 150. In particular, the latter is constituted by a switch 1 according to the invention and already amply described above. The fixed part 200 advantageously comprises driving means 300, which favours insertion and withdrawal of the mobile part 150.

FIG. 11 illustrates a possible embodiment of said mobile part 150. In particular, it comprises a first adaptation plate 151 and a second adaptation plate 152, each of which is located on a side of said outer casing 2.

The adaptation plates 151 and 152 may also have the supplementary purpose of increasing the rigidity of the mobile part 150, so limiting any deformation of the walls of the casing 2, above all in the cases where the switch 1 is installed according to a configuration different from the horizontal one.

Each of these adaptation plates 151 and 152 comprises a first flap 155 and a second flap 156 bent preferably into an L shape or into a U shape in order to slide in shaped guides 210, made on the fixed part 200 of the withdrawable switch 140. The adaptation plates 151 and 152 hence have the function of adapting the switch 1 to the withdrawable configuration.

FIG. 12 illustrates a possible embodiment of the fixed part 200. This is structurally defined by a first side 165 and by a second side 166, set between which are a top cross member 167 and a bottom cross member 168. A rear part 149 completes the structure, bestowing thereon basically the appearance of an open box. Provided at least in the proximity of an area of joining between the sides 165 and 166 and one of the cross members 167 or 168, are shaped guides 210, in which the flaps 155 and 156 of the adaptation plates 151 and 152 of the mobile part 150 slide during coupling of the parts themselves.

As mentioned above, the fixed part 200 comprises driving means 300, which, in the arrangement illustrated, are constituted by a transverse shaft 305, at the end of which shaped volutes 306 are connected. The latter have a central groove 307, which intercepts hooks 159 extending from the adaptation plates 151 and 152.

FIG. 13 illustrates a withdrawable switch according to the invention during the coupling/uncoupling of the two parts. The transverse shaft 305 is set in rotation through a manoeuvring device 400 located up against one of the two sides 155 and 156 of the fixed part 200. The rotation of the transverse shaft 305 brings about rotation of the shaped volutes 306, which act on the hook 159, consequently driving the mobile part 150 in rotation.

The technical solutions adopted for the switch according to the invention thus enable the pre-set tasks and purposes to be fully achieved. The switch has a compact internal structure, which can be easily assembled and is made up of a limited number of components. The use of means of axial support enables installation of the switch in any operating configuration in so far as the deformation of the parts and the phenomena of friction are extremely limited.

The switch thus conceived may undergo numerous modifications and variations, all of which fall within the scope of the inventive idea; moreover all of the items may be constituted by other technically equivalent ones.

In practice, the materials used, as well as the contingent dimensions and shapes, may be any whatsoever according to the requirements and the state of the art.

The invention claimed is:

1. A multi-pole switch (1) for low-voltage systems comprising:

an outer casing (2), containing for each pole at least one fixed contact (10) and at least one mobile contact (20), which can be coupled to/uncoupled from one another;

a mobile element (50), defined by a shaped body comprising at least one seat (25) for each pole of said switch (1), said seat (25) being designed to house at least one mobile contact (20) of a corresponding pole; and an energy-accumulation control mechanism (60) operatively connected to said mobile element (50) to enable its movement, wherein said switch comprises means of axial support, operatively connected to said mobile element (50), said outer casing comprises a bottom (3), which is coupled to a lid (4) through geometrically mated coupling surfaces, said mobile element (50) comprises a plurality of mutually adjacent seats (25), set between which are connecting parts (55*a*, 55*b*) in a position corresponding to which said supporting means are operatively connected to said mobile element (50), said mobile element (50) comprises a first circular connecting part (55*a*) and a second circular connecting part (55*b*), each located between two adjacent seats, said first part (55*a*) and said second part (55*b*) comprising a first radial recess (51) and a second radial recess (52), respectively, and each of said seats (25) is defined by a front wall (26), a rear wall (27) substantially opposite to said front wall (26), a first side wall (28) and a second side wall (29) substantially opposite to one another, said surfaces (26, 27, 28, 29) defining at least one first opening (23) and one second opening, from which there come out, respectively, said mobile contacts (20) and junction means (47), designed to connect electrically said mobile contacts (20) to respective electrodes (22) of said switch (1).

2. The switch (1) according to claim 1, wherein said mechanical means comprise a first connecting rod (91) and a second connecting rod (92), operatively connected to said mobile element (50) through a transverse driving pin (131).

3. The switch (1) according to claim 1, wherein said mobile element (50) is made of thermosetting resin.

4. The switch (1) according to claim 1, wherein said mobile contacts (20) are mounted on a plurality of transverse rotation pins aligned and arranged on housings (23) obtained on said side walls (28, 29) of said seats.

5. The switch (1) according to claim 4, wherein said energy-accumulation control mechanism (60) comprises mechanical means supported by a structural part (70) connected to said outer casing (2).

6. The switch (1) according to claim 5, wherein said structural part (70) of said control mechanism (60) comprises at least one first side (71) and one second side (72), set between which are said mechanical means.

7. The switch (1) according to claim 6, wherein said means for axial support are structurally constrained to said structural part (70) of said control mechanism (60) on an outer side of said first side (71) and of said second side (72).

8. The switch (1) according to claim 1, wherein said means of axial support comprise a first (41) and a second axial bearing (42), said first axial bearing (41) being located between a first terminal part (45) of said mobile element (50) and said outer casing (2), said second axial bearing (42) being located between a second terminal part (46) of said mobile element (50) and said outer casing (2).

9. The switch (1) according to claim 8, wherein said axial bearings (41,42) are of the "thrust-bearing" type.

10. The switch (1) according to claim 8, wherein said axial bearings (41,42) are ball bearings and/or rolling-contact bearings.

11. A withdrawable switch (140), comprising:

a mobile part (150) constituted by a switch (1) according to claim 1; and a fixed part (200), structured so as to contain said mobile part (150) and comprising driving means (300) designed to favor insertion and withdrawal of the mobile part (150).

12. The withdrawable switch (140) according to claim 11, wherein said fixed part (200) is structurally defined by a first side (165) and a second side (166), set between which are a top cross member (167) and a bottom cross member (168).

13. The withdrawable switch (140) according to claim 11, further comprising a first adaptation plate (151) and a second adaptation plate (152), each of which located on one side of said containment casing (2) of said switch (1).

14. The withdrawable switch (140) according to claim 13, wherein said adaptation plates (151, 152) have a first flap (155) and a second flap (156) bent substantially into an L shape and/or into a U shape.

15. The withdrawable switch (140) according to claim 14, wherein it comprises shaped guides (210), within which said bent flaps (155, 156) slide during insertion or withdrawal of said mobile part (150).

16. The switch (1) according to claim 1, wherein said means of axial support are connected to said mobile element (50) through hinge connection means.

17. The switch (1) according to claim 16, wherein means of axial support comprise a first supporting arm (80) and a second supporting arm (81).

18. The switch (1) according to claim 17, wherein said first supporting arm (80) and/or said second supporting arm (81) are structurally constrained to said structural part (70) of said control mechanism (60) through removable fixing means (73).

19. The switch (1) according to claim 18, wherein said structural part (70) comprises fastening protrusions (78) for connection of said control mechanism (60) to said outer casing (2).

20. The switch (1) according to claim 19, wherein said control mechanism (60) is connected to said outer casing (2) through the use of a plurality of axial tie-rods (62) which are inserted in threaded cavities (34) provided on said fastening protrusions (78).

21. The switch (1) according to claim 17, wherein said supporting arms (80, 81) each comprise at least one first operative end (85) connected to said mobile element (50) through said hinge connection means and a second retention end (86) constrained to said structural part (70) of said control mechanism (60).

22. The switch (1) according to claim 21, wherein said supporting arms (80, 81) assume a three-lobed configuration.

23. The switch (1) according to claim 21, wherein said first operative end (85) of each supporting arm (80, 81) is inserted in one of said radial recesses (51, 52) of said mobile element (50) for being connected thereto through said hinge connection means.

24. The switch (1) according to claim 21, wherein said hinge connection means comprise for each supporting arm (80, 81) a rotation pin (110, 111), which is inserted in a first hole (84) made on said operative end (85) and in a second hole provided on the mobile element (50).

25. The switch (1) according to claim 24, wherein said first rotation pin (110) and/or said second rotation pin (111) comprise at least one first calibrated longitudinal portion (112) and at least one second longitudinal retention portion (113), said first calibrated portion (112) being designed to couple with play with the internal surface of said first hole (83), and said second retention portion (113) being designed to be screwed within said second hole (84) of said mobile element (20).

* * * * *